US008578972B2

(12) United States Patent
Duan

(10) Patent No.: US 8,578,972 B2
(45) Date of Patent: Nov. 12, 2013

(54) FABRICS HAVING DOUBLE LAYERS OF TERRY OR PILE

(76) Inventor: Hongwei Duan, Weifang (CN)

( * ) Notice: Subject to any disclaimer, the term of this patent is extended or adjusted under 35 U.S.C. 154(b) by 65 days.

(21) Appl. No.: 13/425,827

(22) Filed: Mar. 21, 2012

(65) Prior Publication Data

US 2012/0255643 A1 Oct. 11, 2012

(30) Foreign Application Priority Data

Apr. 8, 2011 (JP) ..... 2011-002359

(51) Int. Cl.
*D03D 27/08* (2006.01)
*D03D 27/02* (2006.01)
*D03D 27/00* (2006.01)

(52) U.S. Cl.
USPC ..... 139/396; 139/420 R; 139/420 A; 139/426 R; 139/391

(58) Field of Classification Search
USPC ..... 139/21, 37, 116.5, 383 R, 391, 394, 396, 139/403, 405, 420 R, 426 R, 420 A
See application file for complete search history.

(56) References Cited

U.S. PATENT DOCUMENTS 3,838,983 A * 10/1974 Brown et al. ..... 428/608
3,905,831 A * 9/1975 Brown et al. ..... 429/513
4,233,824 A * 11/1980 Schneider ..... 66/87
4,315,419 A * 2/1982 Kernbichler et al. ..... 66/87
4,781,951 A * 11/1988 Kitamura et al. ..... 428/17
5,526,656 A * 6/1996 Conroy et al. ..... 66/193
5,609,935 A * 3/1997 Yamagata et al. ..... 428/89
5,745,961 A * 5/1998 Okawa et al. ..... 24/446
6,305,431 B1 * 10/2001 Fenkes ..... 139/391
7,086,423 B2 * 8/2006 Keller et al. ..... 139/21
8,172,782 B2 * 5/2012 Rock ..... 602/62
2002/0122914 A1 * 9/2002 Rock et al. ..... 428/85
2003/0040809 A1 * 2/2003 Goldmann et al. ..... 623/23.76
2003/0066317 A1 * 4/2003 Ohara et al. ..... 66/170
2004/0106346 A1 * 6/2004 Zafiroglu ..... 442/149
2004/0244863 A1 * 12/2004 Keller et al. ..... 139/391
2005/0022563 A1 * 2/2005 Keller ..... 66/194
2005/0053759 A1 * 3/2005 Rock et al. ..... 428/91
2006/0068155 A1 * 3/2006 Rock et al. ..... 428/85
2008/0057261 A1 * 3/2008 Rock ..... 428/85
2009/0126057 A1 * 5/2009 Rock et al. ..... 2/2.5
2009/0145507 A1 * 6/2009 Takeda et al. ..... 139/384 R (Continued)

FOREIGN PATENT DOCUMENTS

CN 2763305 3/2006
CN 2887909 4/2007

OTHER PUBLICATIONS

Chinese Office Action, dated Nov. 23, 2011, in a counterpart Chinese patent application, No. CN 201110036501.1.

*Primary Examiner* — Bobby Muromoto, Jr.
(74) *Attorney, Agent, or Firm* — Chen Yoshimura LLP

(57) ABSTRACT

A fabric having a ground fabric, and a double layer terry or a double layer pile on either or both surfaces of the ground fabric, or a double layer terry on one surface and a double layer pile on the other surface. The double layer terry has an outer terry and an inner terry lower than the outer terry; the double layer pile has an outer pile and an inner pile lower than the outer pile. The outer terry or outer pile is a natural fiber, and the lower terry or lower pile is a microfiber. Methods of manufacturing the fabric are also disclosed.

16 Claims, 2 Drawing Sheets

(56) References Cited

U.S. PATENT DOCUMENTS

2009/0260126 A1* 10/2009 Rock et al. ..... 2/87
2010/0130903 A1* 5/2010 Rock ..... 602/62
2010/0325773 A1* 12/2010 Rock et al. ..... 2/113
2012/0096690 A1* 4/2012 Chou ..... 24/445
2012/0208416 A1* 8/2012 Lerman ..... 442/1

* cited by examiner

FABRICS HAVING DOUBLE LAYERS OF TERRY OR PILE

BACKGROUND OF THE INVENTION

1. Field of the Invention

This invention relates generally to the technology field of textile, and in particular, it relates to a fabric material and manufacturing methods thereof.

2. Description of the Related Art

Conventional terry or pile fabrics do not have a good sense of layers. These fabrics usually are made of natural fibers. However, natural fibers have their own characteristics. For example, cotton has poor size stability; linen has high stiffness; silk is hard to maintain and store, etc. All of these make their fabric products imperfect. For example, 100 percent cotton terry or pile fabrics have shortage in fluff and softness; moreover, they are not easy to wash and tend to become tough to the feel after repeated washes.

SUMMARY OF THE INVENTION

It is an object of the present invention to provide a fabric that is fluffy, has a good sense of layers, is soft and comfortable, offers durable performance, and is resistant to mildew.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a fabric, including ground fabric and a double layer terry and/or a double layer pile on its surfaces.

In one embodiment, the ground fabric has a double layer terry on a single side of its surface.

In another embodiment, the ground fabric has a double layer terry on each of the two sides of its surface.

In another embodiment, the ground fabric has a double layer terry on one side of its surface and a double layer pile on the other side of its surface.

In another embodiment, the ground fabric has a double layer pile on a single side of its surface.

In another embodiment, the ground fabric has a double layer pile on each of the two sides of its surface.

In one embodiment, the double layer terry includes an outer, higher terry and an inner, lower terry lower than the outer terry.

In another embodiment, the double layer pile includes an outer, higher pile and an inner, lower pile lower than the outer pile.

In one embodiment, the outer high terry or pile is made of a natural fiber which may include cotton, wool, silk, linen, soy fiber or bamboo pulp fiber or a blend yarn; the inner low terry or pile is made of a microfiber. The microfiber is fiber of single component or multi-components, whose single fiber line density is less than 0.55 dtex. Such fabrics made by natural fibers or blend yarn and microfibers have outstanding performance in moisture absorption, gas permeability, softness, comfort and durability.

In one embodiment, the ground fabric is made of synthetic filament or/and natural fiber.

The fabric may be a woven fabric or a knitted fabric. In a knitting process, the microfiber terry alternate with the natural fiber terry or blend yarn terry. Ground stitch materials are synthetic filament or/and natural fiber or/and blend yarn. In a weaving process, the terry warp is a natural fiber or a blend yarn and single component fiber or multi-component fibers which have one component or two components in a single-fiber. For example, superfine polyester fiber is a single component fiber and PET/PA composite fiber is a multi-component fiber. The weft and ground warp are natural fiber or blend yarn or synthetic filament.

In one embodiment, the arrangement ratio of the terry warp and ground warp in the woven fabric is 1:1 or 2:1 or 1:2 or 2:2; the fabric organization is 2/1 fancy warp-backed weave or 3/1 fancy warp-backed weave or 2/2 fancy warp-backed weave. The arrangement ratio of the natural fiber and microfiber in the terry/pile is 1:1 or 1:2 or 2:1.

In one embodiment, the terry or pile of the knitted fabrics is interwoven by microfiber filament and natural fiber yarn or filament or blend yarn, and the ground organization employs chemical fiber filament or blend yarn or natural fiber yarn or filament.

In one embodiment, the manufacturing process includes a single-side pile cutting treatment on the terry fabrics. After post-processing, single-side pile fabric or one-side terry and one-side pile fabrics are produced. The manufacturing process may also include a double-side pile cutting treatment on the terry fabrics. After post-processing, double-side pile fabrics are produced. The post-processing may include unwinding, splitting process, washing, dyeing and setting.

Embodiments of the present invention provide a new fabric, where the double layer terry and/or double layer pile enhance the sense of layers in fabric, makes the fabric more colorful in style, and more comfortable, soft and durable.

It is to be understood that both the foregoing general description and the following detailed description are exemplary and explanatory and are intended to provide further explanation of the invention as claimed.

BRIEF DESCRIPTION OF THE DRAWINGS

The invention will be fully understood, while still further objects and advantages will become apparent, in the following detailed description of preferred embodiments with reference to the accompanying drawing, in which.

In these drawings, 1 refers to a ground fabric; 2 refers to an outer high terry; 3 refers to an inner low terry; 4 refers to a high pile; and 5 refers to a low pile.

DETAILED DESCRIPTION OF THE PREFERRED EMBODIMENTS

Figure 1:
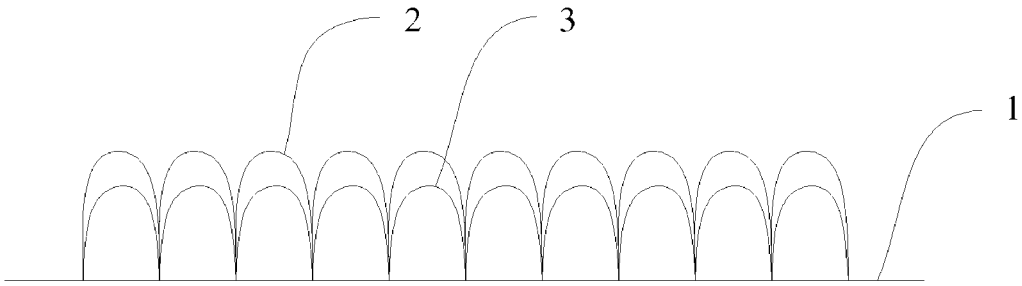
FIG. 1 illustrates the structure of a fabric according to a first embodiment of the present invention.

FIG. 1 illustrates the structure of a fabric according to a first embodiment of the present invention. As shown in FIG. 1, a terry fabric includes ground fabric 1, and the ground fabric 1 has a double layer terry on a single side of its surface. The double layer terry includes an outer high terry 2, and an inner low terry 3 lower than the outer high terry 2. The outer high terry 2 may be a natural fiber terry or a blend yarn terry; the inner low terry 3 may be a microfiber terry. The fabric employing natural fiber and microfiber materials has good capacity of moisture absorption, gas permeability, comfort and durability.

The terry fabric is a woven fabric; the arrangement ratio of terry warp and ground warp in the woven fabric is 1:1 or 2:1 or 1:2 or 2:2, and the fabric organization is 2/1 fancy warp-backed weave or 3/1 fancy warp-backed weave or 2/2 fancy warp-backed weave.

Figure 2:
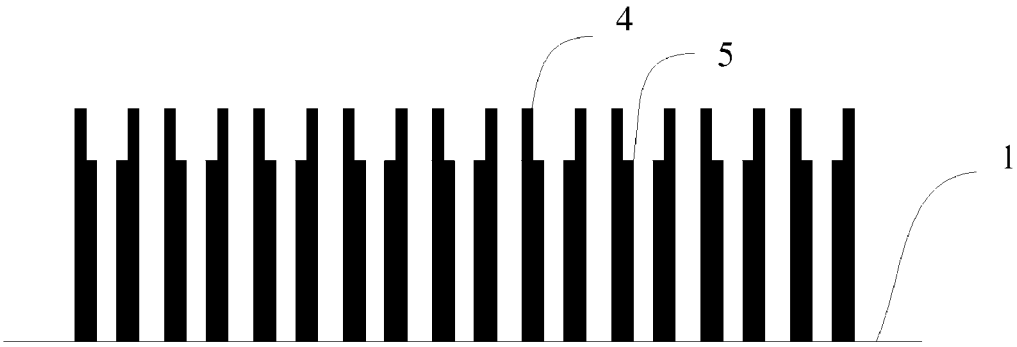
FIG. 2 illustrates the structure of a fabric according to a second embodiment of the present invention.

FIG. 2 illustrates the structure of a fabric according to a second embodiment of the present invention. As shown in FIG. 2, a pile fabric includes ground fabric 1, and the ground fabric 1 has a double layer pile on a single side of its surface. The double layer pile includes an outer high pile 4, and an inner low pile 5 lower than the outer high pile 4. The outer high pile 4 may be a natural fiber pile or a blend yarn pile; the inner low pile 5 may be a microfiber pile. The fabric employing natural fiber and microfiber materials has good capacity of moisture absorption, gas permeability, comfort and durability.

The pile fabric is a knitted fabric. The pile organization of the knitted fabric is interwoven by microfiber filament and natural fiber yarn or filament or blend yarn, and the ground organization employs chemical fiber filament or natural fiber yarn or filament or blend yarn.

Figure 3:
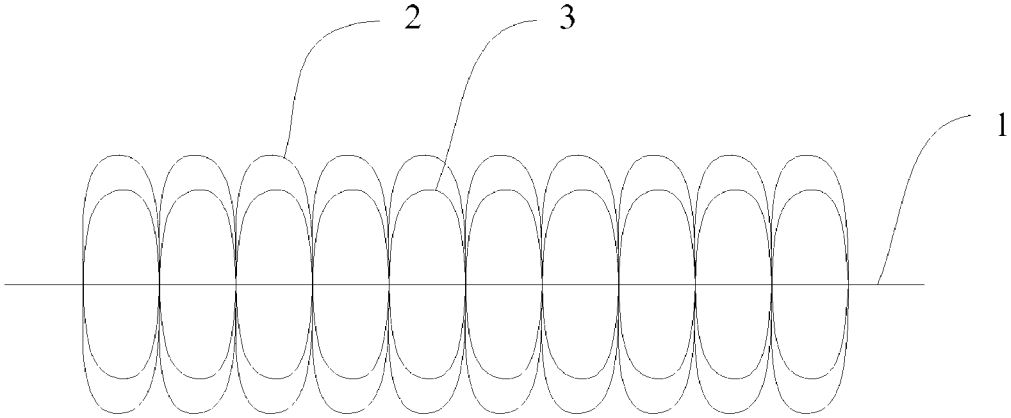
FIG. 3 illustrates the structure of a fabric according to a third embodiment of the present invention.

FIG. 3 illustrates the structure of a fabric according to a third embodiment of the present invention. As shown in FIG. 3, a terry fabric includes ground fabric 1, and the ground fabric 1 has a double layer terry on each of the two sides of its surface. The double layer terry includes an outer high terry 2, and an inner low terry 3 lower than the outer high terry 2. The outer high terry 2 may be a natural fiber terry or a blend yarn; the inner low terry 3 may be a microfiber terry. The fabric employing natural fiber and microfiber materials has good capacity of moisture absorption, gas permeability, comfort and durability.

The terry fabric is a woven fabric; the arrangement ratio of terry warp and ground warp in the woven fabric is 1:1 or 2:1 or 1:2 or 2:2, and the fabric organization is 2/1 fancy warp-backed weave or 3/1 fancy warp-backed weave or 2/2 fancy warp-backed weave.

Figure 4:
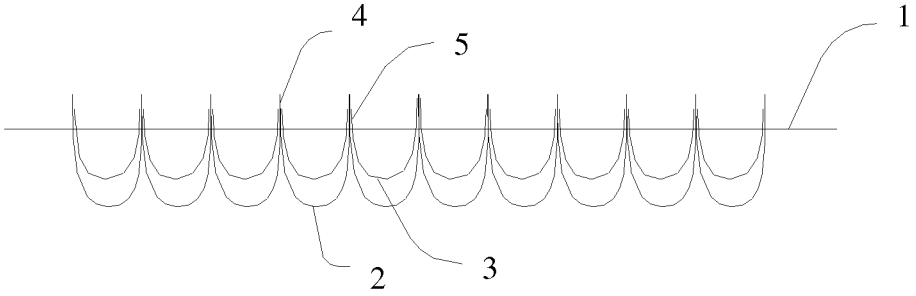
FIG. 4 illustrates the structure of a fabric according to a fourth embodiment of the present invention.

FIG. 4 illustrates the structure of a fabric according to a fourth embodiment of the present invention. As shown in FIG. 4, a terry fabric includes ground fabric 1, and the ground fabric 1 has a double layer terry on one side of its surface and a double layer pile on the other side of its surface. The double layer terry includes an outer high terry 2, and an inner low terry 3 lower than the outer high terry 2. The outer high terry 2 may be a natural fiber terry or a blend yarn terry; the inner low terry 3 may be a microfiber terry. The double layer pile includes an outer high pile 4, and an inner low pile 5 lower than the outer high pile 4. The outer high pile 4 may be a natural fiber pile or a blend yarn pile; the inner low pile 5 may be a microfiber pile.

The terry/pile fabric is a knitted fabric. The terry or pile organization of the knitted fabric is interwoven by microfiber filament and natural fiber yarn or filament or blend yarn, and the ground organization employs chemical fiber filament or natural fiber yarn or filament or blend yarn.

Figure 5:
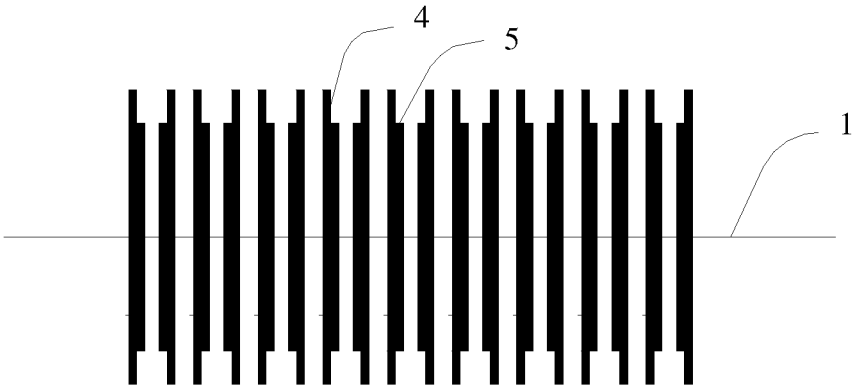
FIG. 5 illustrates the structure of a fabric according to a fifth embodiment of the present invention.

FIG. 5 illustrates the structure of a fabric according to a fifth embodiment of the present invention. As shown in FIG. 5, a terry fabric includes ground fabric 1, and the ground fabric 1 has a double layer pile on each of the two sides of its surface. The double layer pile includes an outer high pile 4, and an inner low pile 5 lower than the outer high pile 4. The outer high pile 4 may be a natural fiber pile or a blend yarn pile; the inner low pile 5 may be a microfiber pile.

The pile fabric is a woven fabric; the arrangement ratio of pile warp and ground warp in the woven fabric is 1:1 or 2:1 or 1:2 or 2:2, and the fabric organization is 2/1 fancy warp-backed weave or 3/1 fancy warp-backed weave or 2/2 fancy warp-backed weave.

In the above embodiments, the blend yarn may contain chemical fiber of less than 40 percent; for example, it may be a blend of 65 percent cotton with 35 percent polyester.

The manufacturing processes for the fabric of the various embodiments are described below. While details of the processes are provided, the invention is not limited to specific steps or parameters given below.

Manufacturing Method Example 1

This manufacturing method may be used to produce the fabric shown in FIGS. 1-5.

The method employs a knitting process, which includes the following steps: preparing packages, warping, preparing warp beam, knitting, unwinding, splitting, washing, dyeing and setting.

The terry materials on the first bar and on the third bar are 150D/72F DTY of PET/PA composite fiber and $32^S$ cotton yarn. Materials on the second bar are 150D/72F DTY of PET/PA composite fiber. Materials on the fourth bar are 200D/96F FDY of PET fiber. The ratio of terry materials on the first bar and the third bar is 1:1. After warping and knitting the grey fabrics are produced. The finished fabrics are produced after post-processing.

The post-processing includes unwinding, splitting, washing, dyeing and setting.

Beam warping is used on warping machine DS21/30.

The fabrics may be knitted on warp knitting machine HKS4-1 which is E24 106 inch tricot. The specific process is as follows: GB1 and GB3: 0-0/2-2//5100 mm/Rack, GB2:5-5/0-0//3450 mm/Rack, GB4:0-1/1-0//3260 mm/Rack.

The dyeing process includes:

(1) Unwinding, preparing fabrics.

(2) Splitting process. The fabrics are kept in a 100° C. 7 g/L sodium hydroxide solution for 80 minutes.

(3) Washing: The fabrics are washed in 40° C. water 10 minutes. Then 1% acetic acid is put in water in order to make the PH of solution to 7.

(4) Dyeing: Disperse dyes are used. The dyeing auxiliary include 1.2 g/L deoiling agent, 0.5 g/L leveling agent and 0.3% peregal. The temperature is increases from 30° C. to 125° C. with 1° C. m increase rate. The fabrics kept in the solution for 30 minutes. Then the temperature is reduced to 60° C. with 2° C./m cooling speed.

(5) Reduction cleaning: Fabrics are kept in 60° C. solution which includes 1 g/L sodium hydrosulfite and 0.5 g/L soda for 20 minutes.

(6) Washing: Fabrics are kept in 40° C. water which includes 3% cleaning agent for 10 minutes.

(7) Post-process: Fabrics are kept in 40° C. water which includes 1.5% Hydrophilic silicone Oil for 20 minutes.

(8) Setting: The setting is done on STB501 machine with the speed of 28 m/minute and temperature is 165° C.

In one embodiment, single-side pile cutting treatment is done on the terry fabrics. After post-processing, single-side pile fabric or one-side terry and one-side pile fabrics are produced. In another embodiment, double-side pile cutting treatment is done on the terry fabrics. After post-processing, double-side pile fabrics are produced. The resulting pile includes high pile 4 and low pile 5.

Manufacturing Method Example 2

This manufacturing method may be used to produce the fabric shown in FIGS. 1-5.

The method employs a weaving process, which includes winding, warping, weaving, dyeing and setting.

300D DTY of PET/PA composite fiber terry alternate with $20^S$ cotton yarn terry in warp terry. The ground warp is 300D DTY of PET/PA composite fiber. The weft is 300D FDY of PET fiber. After warping and weaving the grey fabrics are produced. The finished fabrics are produced after post-processing.

The arrangement ratio of terry warp and ground warp is 1:1 or 2:1 or 2:2. The arrangement ratio of natural fiber and microfiber in terry is 1:1 or 1:2 or 2:1.

The post-processing includes unwinding, splitting process, washing, dyeing and setting.

In one embodiment, single-side pile cutting treatment is done on the terry fabrics. After post-processing, single-side pile fabric or one-side terry and one-side pile fabrics are produced. In another embodiment, double-side pile cutting treatment is done on the terry fabrics. After post-processing, double-side pile fabrics are produced. The pile includes high pile 4 and low pile 5.

Drum warping is used on warping machine SHGA215C.

The fabrics may be woven on rapier and Jacquard loom TPS600 and CR-m-2000-230.

The terry weaves is 3/1 fancy warp-backed weaves. The ground structure is 2/2 warp-backed weaves. Two times short beating-up and two times long beating-up are finished to form a terry.

The dyeing process includes:

(1) Unwinding, preparing fabrics.

(2) Splitting process. The fabrics are kept in 100° C. 7 g/L sodium hydroxide solution for 80 minutes.

(3) Washing: The fabrics are washed in 40° C. water for 10 minutes. Then put 1% acetic acid in the water in order to make the PH of solution to 7.

(4) Dyeing: Disperse dyes are used. The dyeing auxiliary include 1.2 g/L deoiling agent, 0.5 g/L leveling agent and 0.3% peregal. The temperature is increases from 30° C. to 125° C. with 1° C./m heating rate. The fabrics are kept in the solution for 30 minutes. Then the temperature is reduced to 60° C. with 2° C./m cooling rate.

(5) Reduction cleaning: Fabrics are kept in 60° C. solution which includes 1 g/L sodium hydrosulfite and 0.5 g/L soda for 20 minutes.

(6) Washing: Fabrics are kept in 40° C. water which includes 3% cleaning agent for 10 minutes.

(7) Post-process: Fabrics are kept in 40° C. water which includes 1.5% Hydrophilic silicone Oil for 20 minutes.

(8) Setting: The setting is done on STB501 machine with the speed of 28 m/minute and temperature is 165° C.

The following points are noted for the weaving process:

(1) In order to form clear shed, the terry warp is thread though the frond dents and ground warp is thread though the back dents.

(2) The dent number should be lower; otherwise there will be more difficulties in the weaving process. The same group terry warp and ground warp are threaded though the same dents.

(3) In order to obtain good softness and high level of moisture absorption, 300D DTY of PET/PA composite fiber is selected as ground warp and internet textured yarn is selected as terry warp.

Manufacturing Method Example 3

This manufacturing method may be used to produce the fabric shown in FIGS. 1-5.

The method employs a knitting process, where the microfiber terry alternate with the natural fiber terry or the blend yarn terry. The ground stitch materials are synthetic filament or/and natural fiber or/and blend yarn.

The post-processing contains unwinding, splitting process, washing, dyeing and setting.

In one embodiment, single-side pile cutting treatment is done on the terry fabrics. After post-processing, single-side pile fabric or one-side terry and one-side pile fabrics are produced. In another embodiment, double-side pile cutting treatment is done on the terry fabrics. After post-processing, double-side pile fabrics are produced.

Manufacturing Method Example 4

This manufacturing method may be used to produce the fabric shown in FIGS. 1-5.

The method employs a weaving process, where the terry warp is natural fiber or blend yarn and single component fiber or multi-component fiber. The weft and ground warp are natural fiber or blend yarn or synthetic filament.

The arrangement ratio of terry warp and ground warp is 1:1 or 2:1 or 1:2 or 2:2. The arrangement ratio of natural fiber and microfiber in terry is 1:1 or 1:2 or 2:1.

The fabric structure is 2/1 or 3/1 or 2/2 fancy warp-backed weaves.

The post-processing contains unwinding, splitting process, washing, dyeing and setting.

In one embodiment, single-side pile cutting treatment is done on the terry fabrics. After post-processing, single-side pile fabric or one-side terry and one-side pile fabrics are produced. In another embodiment, double-side pile cutting treatment is done on the terry fabrics. After post-processing, double-side pile fabrics are produced.

The fabric described above combines the advantage of natural fiber with the advantage of microfiber. In use, the surface fiber which touches the skin directly is natural fiber. It can meet users' expectations that fabrics are comfortable and have high level of moisture absorption and good air permeability. At the same time, the fabrics have great advantages in softness, moisture absorption, air permeability, durability and mildew resistance.

It will be apparent to those skilled in the art that various modification and variations can be made in the fabrics of the present invention without departing from the spirit or scope of the invention. Thus, it is intended that the present invention cover modifications and variations that come within the scope of the appended claims and their equivalents.

What is claimed is:

1. A fabric, comprising:

a ground fabric having a first and a second surface; and a double layer terry having an outer terry and an inner terry lower than the outer terry, or a double layer pile having an outer pile and an inner pile lower than the outer pile, on the first surface of the ground fabric, wherein the outer terry or outer pile is made of a natural fiber or a blended yarn, and the lower terry or lower pile is made of a microfiber.

2. The fabric of claim 1, wherein the fabric comprises a double layer terry on the first surface of the ground fabric, the fabric further comprising another double layer terry having an outer terry and an inner terry lower than the outer terry on the second surface of the ground fabric.

3. The fabric of claim 1, wherein the fabric comprises a double layer terry on the first surface of the ground fabric, the fabric further comprising a double layer pile having an outer pile and an inner pile lower than the outer pile on the second surface of the ground fabric.

4. The fabric of claim 1, wherein the fabric comprises a double layer pile on the first surface of the ground fabric, the fabric further comprising another double layer pile having an outer pile and an inner pile lower than the outer pile on the second surface of the ground fabric.

5. The fabrics of to claim 1, wherein the natural fiber includes cotton, wool, silk, linen, soybean fiber or bamboo fiber, the blend yarn contains chemical fiber of less than 40 percent, and the microfiber is a single component fiber or multi-component fiber with a single-fiber density below 0.55 dtex.

6. The fabrics of to claim 1, wherein the ground fabric is made of a synthetic filament and/or a natural fiber and/or a blend yarn.

7. The fabrics of to claim 1, wherein the fabric is a woven fabric or knitted fabric.

8. The fabrics of to claim 1, wherein the fabric is a woven fabric, and wherein an arrangement ratio of a terry warp and a ground warp in the woven fabric is 1:1 or 2:1 or 1:2 or 2:2, an arrangement ratio of the natural fiber and microfiber in the fabric is 1:1 or 1:2 or 2:1.

9. The fabric of claim 8, wherein a fabric organization is 2/1 or 3/1 or 2/2 fancy warp-backed weave.

10. A method of manufacturing a fabric, the fabric comprising a ground fabric having a first and a second surface and a double layer terry having an outer terry and an inner terry lower than the outer terry, or a double layer pile having an outer pile and an inner pile lower than the outer pile, on the first surface of the ground fabric, the method comprising:

alternately knitting a microfiber terry and a natural fiber terry or a blend yarn terry with a ground stitch, wherein the microfiber terry form the inner terry and the natural fiber terry or a blend yarn terry form the outer terry of the fabric.

11. The method of claim 10, wherein the natural fiber includes cotton, wool, silk, linen, soybean fiber or bamboo fiber, the microfiber is single component fiber or multi-component fiber having a single-fiber density below 0.55 dtex, and the ground stitch material is synthetic filament or/and natural fiber or/and blend fiber.

12. The method of claim 10, further comprising:

performing a single-side or double-side pile cutting treatment on the terry fabrics to form single-side pile fabric, one-side terry and one-side pile fabrics, or double-side pile fabric.

13. The method of claim 12, further comprising, after the pile cutting treatment:

post-processing including unwinding, splitting process, washing, dyeing and setting.

14. A method of manufacturing a fabric, the fabric comprising a ground fabric having a first and a second surface and a double layer terry having an outer terry and an inner terry lower than the outer terry, or a double layer pile having an outer pile and an inner pile lower than the outer pile, on the first surface of the ground fabric, the method comprising:

weaving a terry warp of a natural fiber and a terry warp of a single component fiber or multi-component fiber with a weft and a ground warp made of a natural fiber or synthetic filament or blend yarn.

15. The method of claim 14, wherein an arrangement ratio of the terry warp and the ground warp is 1:1 or 2:1 or 1:2 or 2:2, and an arrangement ratio of the natural fiber and microfiber in the terry warp is 1:1 or 1:2 or 2:1.

16. The method of claim 15, wherein a fabric organization is 2/1 or 3/1 or 2/2 fancy warp-backed weaves.

* * * * *